US005185897A

United States Patent [19]

Van Laanen

[11] Patent Number: 5,185,897

[45] Date of Patent: Feb. 16, 1993

[54] INFLATABLE MATERNITY MATTRESS

[76] Inventor: Michael W. Van Laanen, 435 S. St. Bernard St., DePere, Wis. 54115

[21] Appl. No.: 903,509

[22] Filed: Jun. 24, 1992

[51] Int. Cl.[5] ..... A47C 27/10

[52] U.S. Cl. ..... 5/455; 5/449; 5/631; 5/465; 5/922; 5/930

[58] Field of Search ..... 5/449, 455, 458, 462, 5/465, 631, 657, 922, 930

[56] References Cited

U.S. PATENT DOCUMENTS

| | | | |
|---|---|---|---|
| 2,046,645 | 7/1936 | Mason | 5/465 |
| 2,089.954 | 8/1937 | Pellegrini . | |
| 2,099,870 | 11/1937 | Stanley | 5/455 |
| 2,582,439 | 1/1952 | Kavanagh | 5/455 |
| 3,042,940 | 7/1962 | Keaton | 5/458 |
| 3,419,920 | 1/1969 | Maddux | 5/465 |
| 3,605,138 | 9/1971 | Tucker | 5/455 |
| 3,988,793 | 11/1976 | Abitbol | 5/930 |
| 4,021,872 | 5/1977 | Powell | 5/930 |
| 4,051,566 | 10/1977 | Esquivel . | |
| 4,054,960 | 10/1977 | Pettit et al. . | |
| 4,074,373 | 2/1978 | Garofalo | 5/922 |
| 4,617,690 | 10/1986 | Grebe | 5/455 |
| 4,737,999 | 4/1988 | Halverson | 5/930 |

*Primary Examiner*—Renee S. Luebke
*Assistant Examiner*—F. Saether
*Attorney, Agent, or Firm*—Andrus, Sceales, Starke & Sawall

[57] ABSTRACT

An inflatable mattress construction having use as a maternity mattress. The mattress is provided with a central, generally cylindrical cavity which extends through the thickness of the mattress. The lower end of the cavity is enclosed by a bottom panel, while a top panel is located within the cavity and the peripheral edge of the top panel is sealed to the upper surface of the mattress bordering the cavity. The central portion of the top panel is secured to the bottom panel. A gas, such as air, can be supplied to the chamber between the panels to thereby inflate the upper panel and adjust the depth of the cavity to accomodate the abdomen of a pregnant woman.

14 Claims, 1 Drawing Sheet

INFLATABLE MATERNITY MATTRESS

BACKGROUND OF THE INVENTION

Maternity mattresses have been proposed in the past, in which the mattress is provided with a cavity in its upper surface, adapted to receive the abdomen of a pregnant woman resting face down on the mattress, so that maximum support may be provided with a minimum amount of discomfort.

One type of maternity mattress has been associated with a normal inner spring bed mattress, in which the coil spring mattress, which is supported on a box spring, is provided with a cavity to receive the abdomen of the pregnant woman. This type of maternity mattress is illustrated in U.S. Pat. No. 4,051,566. To adjust the depth of the cavity in the mattress, an insert is mounted in the cavity and is supported by a power operated mechanism located beneath the bed. Through operation of the power mechanism, the insert can be raised and lowered within the cavity to provide the desired depth of cavity to accommodate the abdomen.

U.S. Pat. No. 4,054,960 describes an inflatable maternity mattress in which the central portion of the mattress is provided with a generally cylindrical opening or cavity to receive the abdomen of the pregnant woman. To adjust the depth of the cavity, air is introduced or exhausted from the mattress. This not only adjusts the depth of the cavity, but also changes the thickness or height of the mattress. Thus, to provide a cavity with a minimum depth, air is exhausted from the mattress to correspondingly reduce the thickness of the mattress to a minimum.

U.S. Pat. No. 4,054,960 also shows an inflatable plug to be inserted within the opening in the mattress when the central cavity is not required.

U.S. Pat. No. 2,089,854 is directed to a maternity cot and mattress, in which the mattress and the supporting cot are provided with aligned openings adapted to receive the abdomen of a pregnant woman. The lower end of the opening or cavity is enclosed by a pair of adjustable straps which are disposed in an X-shaped configuration. By lengthening or shortening the straps through use of a buckle, the depth of the cavity can be adjusted to accommodate various stages of pregnancy.

SUMMARY OF THE INVENTION

The invention is directed to an inflatable mattress that can be used as a maternity mattress. The central portion of the mattress is provided with a cavity or opening, which extends through the thickness of the mattress and the cavity is bordered by a cylindrical section of the mattress. Enclosing the bottom of the cavity is a lower panel, while a flexible upper panel is disposed in the cavity and the outer peripheral edge of the upper panel is secured to the upper surface of the mattress bordering the cavity. The central portion of the upper panel is secured or fixed to the central portion of the lower panel. With this construction, the space between the cylindrical section of the mattress bordering the cavity and the upper and lower panels, defines a closed chamber.

Air, or other gas under pressure, can be supplied to the chamber separate from the air which is supplied to the mattress itself.

In a deflated condition, the upper panel drapes downwardly along the cylindrical section bordering the cavity and is folded on itself. In this condition, the cavity is at its greatest depth. To decrease the depth of the cavity, air is introduced into the chamber causing the upper panel to inflate or move upwardly. In the fully inflated position, the outer peripheral portion of the upper panel will be substantially flush with the upper surface of the mattress, while the center of the upper panel is still tied to the lower panel. In this condition, the depth of the cavity is at a minimum and due to the securement of the upper panel to the lower panel, the upper panel will not bulge upwardly out of the cavity and fold over the mattress in a condition which could be uncomfortable to the user.

With the construction of the invention, the depth of the cavity can be varied independently, while maintaining the mattress in a fully inflated condition.

The tie in between the upper and lower panels provides a controlled adjustment of the depth of the cavity and yet prevents the upper panel from bulging out and folding over the mattress when in an inflated condition.

As a feature of the invention, a separate inflatable plug can be inserted in the cavity to close off the cavity, so that the mattress can be used in a normal manner. The plug can be inflated to a condition where it will accommodate the depth of the cavity. For example, if the chamber in the cavity is in a deflated condition, the plug can be inflated only to a size to accommodate that depth of cavity. Conversely, if the chamber is partially inflated, the plug need only be partially inflated to accommodate the depth of the cavity in that condition.

It is contemplated that straps can be attached to the plug and the straps can then be attached by fasteners, such as hook and loop fasteners, to the upper surface of the mattress to maintain the plug within the cavity. When not being used to enclose the cavity, it is contemplated that the plug can also be used as a pillow or headrest.

While the mattress of the invention has a particular use as a maternity mattress, with the plug inserted, it can also be used as a recreational mattress for use in camping, swimming, etc.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
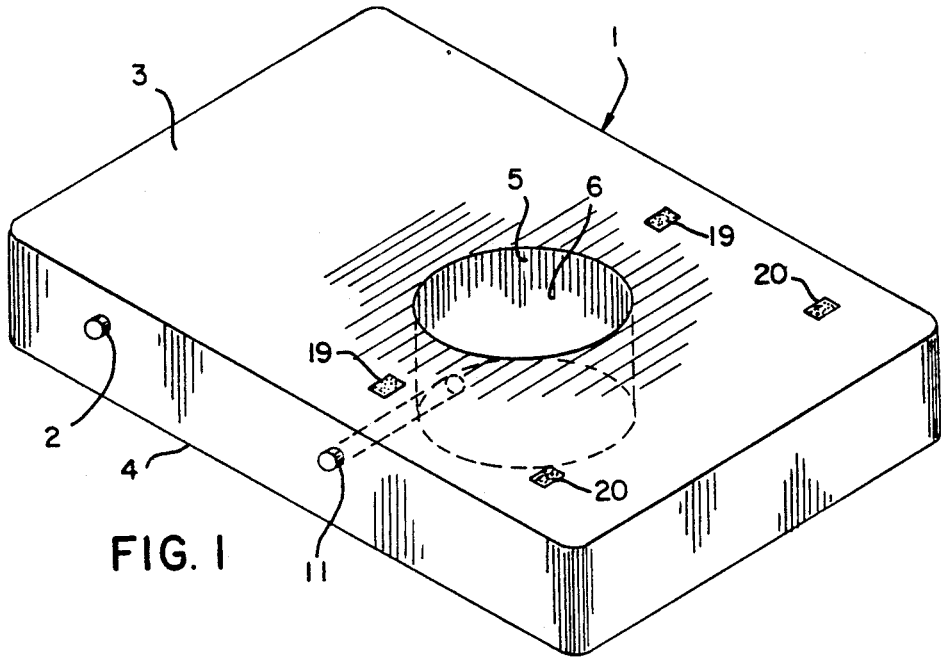
FIG. 1 is a perspective view of the inflatable mattress of the invention.

FIG. 1 of the drawings illustrates an inflatable mattress 1 formed of rubber or plastic material and an air inlet line 2 is connected to the interior of the mattress and a conventional check valve is associated with air line 2. By connecting air line 2 to a suitable source of air, or other gas, under pressure, the mattress 1 can be inflated. The interior of the mattress may be provided with a number of chambers or coils, not shown, which provide stability for the mattress when in the inflated state.

Mattress 1 includes an upper surface 3 and a lower surface 4, and a generally cylindrical section 5 connects the upper and lower surfaces 3 and 4. The cylindrical section 5 defines a cavity or opening 6.

Figure 2:
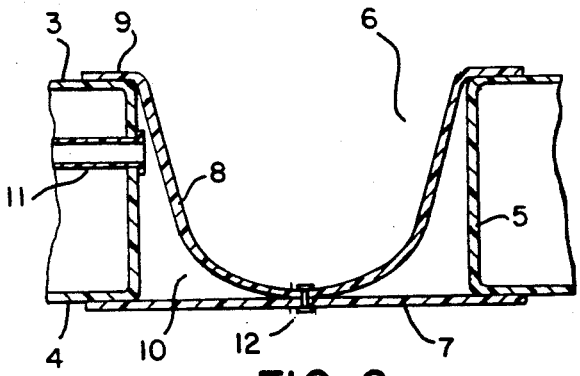
FIG. 2 is a fragmentary vertical section showing the chamber in the central cavity in a deflated condition.

As shown in FIG. 2, the lower end of cavity 6 is enclosed by a lower flexible panel 7, the edges of which are bonded to the lower surface 4 of the mattress bordering cavity 6.

Located within the cavity 6 is an upper panel 8 which has a substantially greater surface area than the area of cavity 6. As shown in FIG. 2, the outer peripheral edge 9 of upper panel 8 is bonded, or otherwise secured, to the upper surface 3 of the mattress bordering cavity 6. The space between the upper panel 8 and lower panel 7 and cylindrical section 5 defines a chamber or compartment 10.

The central portion of upper panel 8 is secured or tied to the central portion of the lower panel 7, as indicated by 11.

The chamber 10 is adapted to be separately inflated and in this regard, an air line 11 is mounted in cylindrical wall 5 and extends through the interior of mattress 1 and exits along a side of the mattress, as shown in FIG. 1. Air line 11 includes a conventional check valve. By introducing air or other gas into line 11, the chamber 10 can be inflated, as will be hereinafter described.

FIG. 2 shows a condition in which the chamber 10 is in a deflated condition and the cavity has a maximum depth to accommodate a later stage of pregnancy. In this condition, the upper panel 8 is draped downwardly along the cylindrical wall 5.

Figure 3:
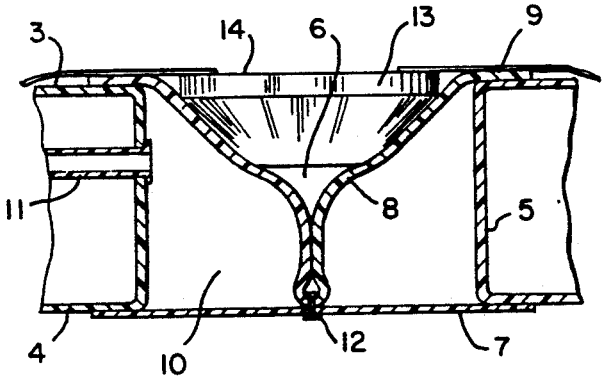
FIG. 3 is a view similar to FIG. 2 showing the chamber in a partially inflated condition.

FIG. 3 shows a condition in which the chamber 10 is partially inflated through the introduction of gas through line 11. In this condition, the upper panel is retained in engagement with the lower panel 7 at the area of tie or connection 12. In this condition the depth of the cavity 6 has been reduced.

Figure 4:
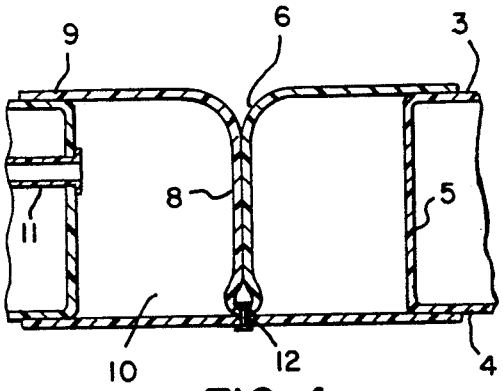
FIG. 4 is a view similar to FIG. 2 showing the cavity in a substantially inflated condition.

FIG. 4 shows the chamber 10 in a substantially fully inflated condition and in this condition the peripheral portion of the upper panel 8 is substantially flush with the upper surface 3 of the mattress. In this condition the cavity has a minimum depth.

The tie 12 between the panels 7 and 8 performs several important functions. Initially, it centers the upper panel relative to the lower panel to maintain the shape or integrity of the cavity. As a second function, the tie 12 prevents the upper panel from bulging outwardly of the cavity when the chamber is in the inflated condition and folding over the upper surface of the mattress. Any such fold on the upper surface of the mattress could prove uncomfortable to the user.

As the introduction of air into the chamber 10 is independent from the introduction of air into the mattress 1 itself, the depth of the cavity can be adjusted independently of adjustment of the inflation of the mattress. Thus, the mattress can be retained at a fully inflated condition, while the depth of the cavity, which accommodates the abdomen of the pregnant woman, can be independently adjusted as desired.

As a feature of the invention, an inflatable plug 13, made of a rubber-like or plastic material, can be inserted into the cavity 6 to enclose the cavity, so that the mattress can be used in a normal manner. Plug 13 includes a generally flat upper surface 14 and a rounded or dome-shaped lower surface 15. When the plug is inserted in the cavity, as shown in FIG. 3, upper surface 14 will be substantially flush with the upper surface 3 of the mattress.

Plug 13 and can inflated through introduction of air through the inflation tube 16 which includes a conventional valve mechanism.

Depending upon the depth of the cavity, the plug 13 can be inflated to a state where it will fit within the cavity, so that the upper surface 14 is flush with the upper surface of the mattress.

Figure 5:
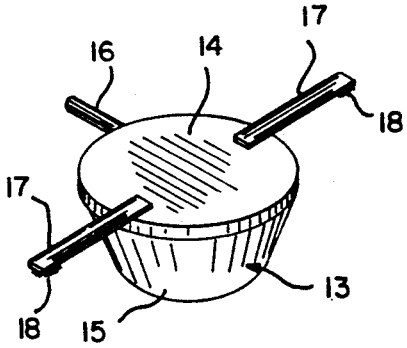
FIG. 5 is a perspective view of a plug that can be inserted in the cavity.

As shown in FIG. 5, plug 13 is provided with a pair of opposed flexible straps 17 and the straps are adapted to be connected to the mattress 1 through a fastening mechanism which can take the form of hook and loop fasteners sold under the tradename Velcro. In this construction, hook elements 18 can be attached to the underside of straps 17 and engage loop elements 19 which are mounted in spaced relation in either side of the cavity 6. Engagement of the hoop and loop fasteners will maintain the plug in position in cavity 6.

It is also contemplated that the plug 13, if not being used enclose cavity 6, can be used as a headrest, or pillow. In this regard, a pair of loop elements 20, similar to loop elements 19 are mounted in spaced relation on the upper surface 3 of the mattress adjacent a mattress end. The hook elements 18 on the plug can be attached to the hook elements 20 to maintain the plug in position as a pillow or headrest.

With the plug inserted within cavity 6, the mattress 1 can be used in other applications, as for example, a beach or recreational mattress, for camping, or for an auxiliary sleeping mattress in a residence.

Various modes of carrying out the invention are contemplated as being within the scope of the following claims particularly pointing out and distinctly claiming the subject matter which is regarded as the invention.

I claim:

1. An inflatable mattress construction, comprising an inflatable mattress, first inflating means for introducing gas into the mattress to inflate the mattress, said mattress having a central cavity extending through the thickness of the mattress, a bottom panel enclosing the bottom of the cavity, a top panel disposed in the cavity and having a peripheral edge secured to the portion of the mattress bordering the cavity, connecting means for connecting a central point of the top panel to a central point of the bottom panel, and second inflating means for introducing gas into the space between said top and bottom panels to selectively adjust the effective depth of the cavity.

2. The mattress construction of claim 1, wherein said central cavity is bordered by a generally cylindrical wall section of the mattress.

3. The mattress construction of claim 1, wherein the peripheral edge of said top panel is secured to the upper surface of said mattress bordering said cavity.

4. The mattress construction of claim 1, wherein said second inflation means includes a tube extending within the interior of said mattress to the outside of the mattress.

5. The mattress construction of claim 1, and including an inflatable flexible plug to be inserted in said cavity.

6. The mattress construction of claim 5, and including attaching means for removably attaching the plug to the mattress when said plug is inserted in the cavity.

7. The mattress construction of claim 6, wherein said attaching means comprises a strap extending outwardly from said plug, and fastening means connecting said strap to the upper surface of the mattress.

8. The mattress construction of claim 7, wherein said fastening means comprises a hook member and engageable loop member, a first of said members being secured to the upper surface of the mattress and the other of said members being secured to said strap.

9. The mattress construction of claim 8, wherein said construction includes a pair of said straps extending outwardly from opposite sides of said plug, and said construction includes a pair of said first members located on opposite sides of said cavity.

10. The mattress construction of claim 5, and including means for attaching the plug to an end of the upper surface of the mattress so that said plug can serve as a pillow.

11. An inflatable mattress construction, comprising an inflatable mattress, first inflation means for introducing gas into the mattress to inflate the mattress, said mattress having a central cavity extending through the thickness of said mattress and bordered by a generally cylindrical wall, a lower panel enclosing the bottom of said cavity, an upper panel disposed within the cavity and having a peripheral edge secured to the upper surface of said mattress bordering said cavity, connecting means for connecting a central portion of the upper panel to a central portion of the lower panel, the space defined by said lower panel and said upper panel and said cylindrical wall defining a chamber, and second inflation means for introducing a gas into said chamber to thereby inflate said chamber and adjust the depth of said cavity.

12. The mattress construction of claim 11, wherein said second inflation means includes a conduit communicating with the chamber and extending through the interior of the mattress to the exterior.

13. The mattress construction of claim 11, wherein the surface area of said upper panel is substantially greater than the area of said cavity.

14. The mattress construction of claim 11, wherein said upper panel has a first position in which said upper panel extends downwardly along said cylindrical wall and said cavity has a maximum depth and a second position in which the upper panel is substantially flush with the upper surface of the mattress and the cavity has a minimum depth.

* * * * *